United States Patent [19]

Earley

[11] 4,162,590

[45] Jul. 31, 1979

[54] BURGLAR BAR APPARATUS

[76] Inventor: Vernon A. Earley, 327 Woodbine St., Jacksonville, Fla. 32206

[21] Appl. No.: 869,951

[22] Filed: Jan. 16, 1978

[51] Int. Cl.[2] ..... E06B 3/68

[52] U.S. Cl. ..... 49/55; 49/57; 52/507

[58] Field of Search ..... 49/50, 51, 55, 57; 52/507, 645, 509; 160/374; 292/259, 346

[56] References Cited

U.S. PATENT DOCUMENTS

| | | | |
|---|---|---|---|
| 1,045,837 | 12/1912 | Hager | 160/374 X |
| 2,503,503 | 4/1950 | McGaffen | 292/259 X |
| 3,942,576 | 3/1976 | Rickard | 49/55 X |

*Primary Examiner*—Kenneth Downey

*Attorney, Agent, or Firm*—George H. Baldwin; Arthur G. Yeager

[57] ABSTRACT

A burglar bar apparatus for mounting to a frame of a window opening in a building includes at least one extendable mounting member on at least one side edge of the apparatus and having substantially coextensive guard means externally protecting such mounting member.

12 Claims, 3 Drawing Figures

BURGLAR BAR APPARATUS

BACKGROUND OF THE INVENTION

This invention relates generally to security devices and specifically to a burglar bar apparatus suitable for mounting in a window casement or the like.

It has been well known to prevent unauthorized ingress and egress through an opening in a building by rigidly mounting a bar, or a series of parallel, spaced bars and cross bars or the like in the opening. The mounting arrangement therefor may take any one of several known forms. For example, each individual bar may be cut such that its length exceeds the height or width of the opening and each bar may be set in the opening with its ends rigidly secured or otherwise set in the frame.

More recently, burglar bars have been manufactured having a first set of elongated parallel, spaced bars rigidly mounted together by a second set of spaced bars with the second set of bars being oriented substantially perpendicularly to the first set. Such burglar bar constructions or grids are then equipped with a number of rigid mounting pins or shafts which are mounted respectively to, and extend outwardly from, each end of each of the second set of bars. These mounting shafts are employed to mount the burglar bar grid into the window frame or the like. By using such shafts, it is possible to prefabricate the burglar bar grid in a standard rectangular shape and approximate size and to mount such prefabricated grids in a number of windows, despite significant variations in window dimensions, by varying the depth of the cavities into which the mounting shafts are inserted. By so doing, the significant expense of custom fabricating individual burglar bar grids for each window is eliminated.

Despite cost saving, however, the use of such mounting shafts results in a burglar bar grid that is more easily breached than one that is custom constructed and installed for each individual window. This is generally true due to the fact that the mounting shafts are virtually always left exposed over the portion of their length between the window frame and the end of the bar to which they are mounted. Such exposure may enable a burglar, intent upon breaching the grid, to cut the shafts with a bolt cutter, saw or the like, and to thereby remove the grid from the frame.

There is thus a need for a burglar bar apparatus which is adaptable to mounting in a variety of window frames having small but significant variations in window frame dimensions, and which, at the same time, provides sufficient structural impediment to breaching the integrity of the apparatus at the window frame mounting points.

SUMMARY

It has now been discovered that an improved burglar bar apparatus which avoids the problems generally associated with conventional burglar bars may be fabricated from at least two elongated bars in parallel spaced relation and cross bars being rigidly mounted thereto, a plurality of extendable mounting members and a plurality of substantially coextensive guard means with each guard means rigidly mounted to each mounting member and each mounting member being extendably mounted to adjacent ends of the elongated bars.

BRIEF DESCRIPTION OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DESCRIPTION OF THE PREFERRED EMBODIMENT

Figure 1:
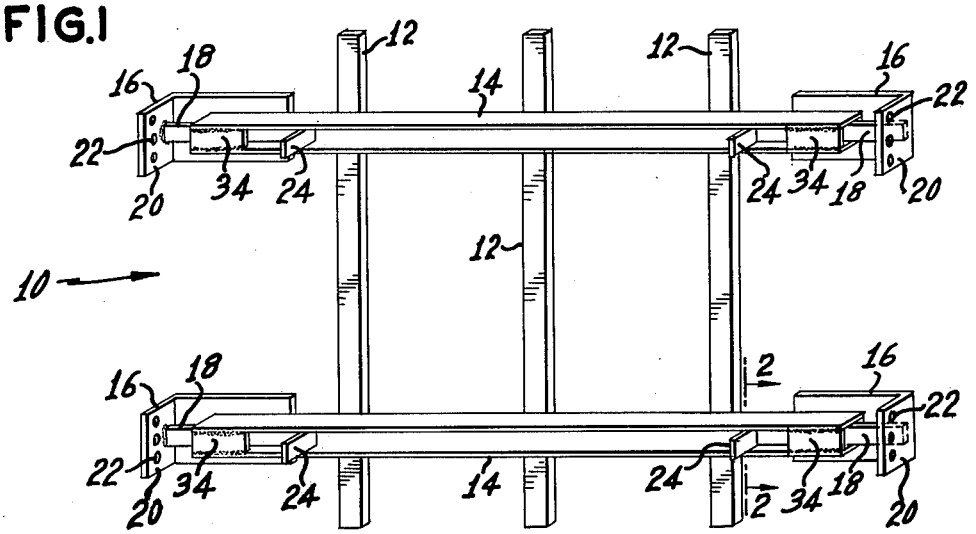
FIG. 1 is a perspective view of the burglar bar apparatus constructed in accordance with the invention as seen from the interior of a building.

Referring to FIG. 1, a burglar bar apparatus is indicated generally at 10 and comprises a plurality of solid cross bars 12 which are rigidly mounted to elongated U-shaped or channeled bars 14 generally perpendicularly thereto and a plurality of extendable mounting members 16 are attached to each of the ends of bars 14.

Figure 2:
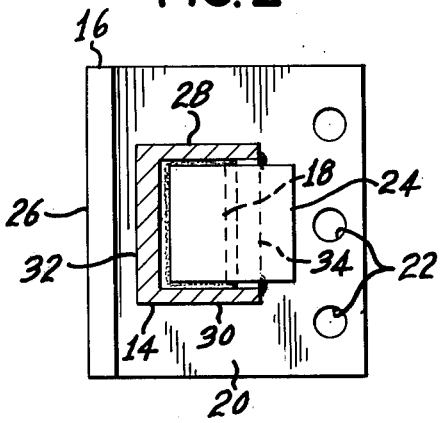
FIG. 2 is an enlarged transverse vertical section of an extendable mounting member and guard means taken along line 2—2 of FIG. 1.
Figure 3:
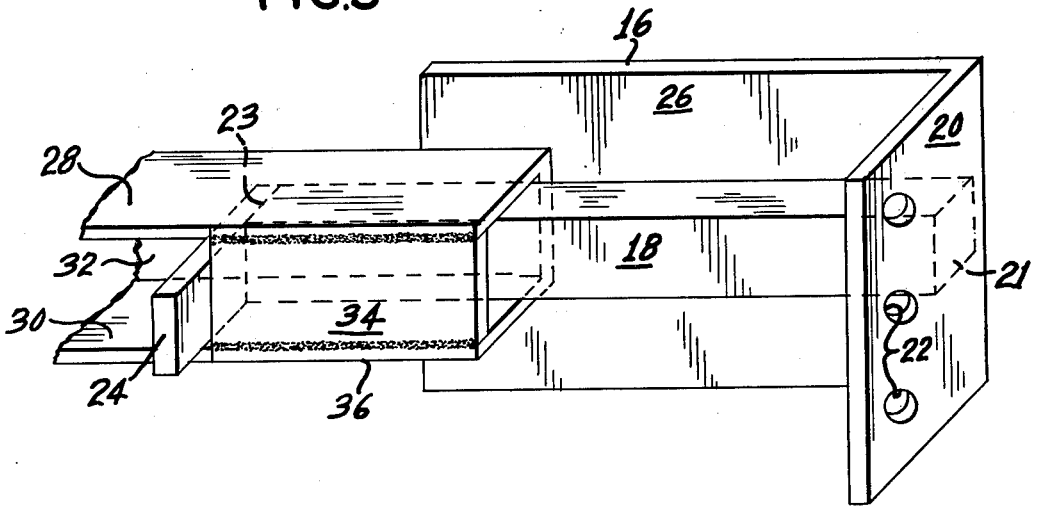
FIG. 3 is an enlarged view of an extendable mounting member and guard means.

Referring to FIGS. 2 and 3 each mounting member 16 is seen to comprise a ractangular third bar or slidable member 18, a mounting plate 20, having apertures 22 therethrough, rigidly mounted perpendicularly to a first end 21 of rectangular member 18, a stop lug 24 rigidly mounted perpendicularly to a second end 23 of member 18, and a wide guard plate 26 mounted perpendicularly to mounting plate 20 and parallel to slide bar 18. As may also been seen in FIGS. 2 and 3 bars 14 are channel shaped having parallel sides 28 and 30 respectively and bottom side 32. A stop plate 34 is welded between the free ends of the two parallel sides 28 and 30 adjacent each of the ends of bars 14 to form a box member end 36 through which slide bar 18 is slidingly disposed.

Thus a burglar bar apparatus 10 is provided for mounting within a frame in a building and includes at least one bar 14 including opposite end portions extending generally between the opposite sides of the frame. Mounting means 16 is attached to at least one end portion of the bar 14 and includes a plate 20, and an extendable member 18 having an end portion connected to plate 20 to position same in contact with the adjacent side of the frame whereby the plate 20 may be affixed thereto. Guard means 26 in the form of a wide plate is plate 20 and extends toward bar 14 to generally overlie the extendable member 18 regardless of the extension thereof. The guard means 26 is closely spaced outwardly and generally parallel to extendable member 18 and also extending laterally thereof whereby breaching of the extendable member 18 is rendered more difficult or inhibited. In the preferred embodiment, the apparatus 10 includes another spaced bar 14 having opposite end portions and extends generally between the opposite sides of the frame, and cross bars 12 connect the one and other spaced bars 14 together to form a rectangular burglar bar grid. At least one other identical mounting means 16 is attached to one end portion of the other bar on the same window frame side as the previously mentioned mounting means 18. Also, another pair of identical mounting means are respectively attached to the other end portions of the elongated bars for attachment to the opposite side of the frame.

Furthermore, mounting means 16 further includes a channel member, which may be the end portion of bar 14, into which the extendable member 18 is slidingly disposed, and stop means, in the form of flange portion 24 of extendable member 18 and stop plate 34, limits the extension of the extendable member 18 from the channel member.

The guard plate 26 extends laterally above and below extendable member 18 and extends therefrom toward the bar greater than the exposed extension thereof and extends laterally above and below the bar to shield such extendable member 18.

Each of the stop means includes an element 34 connected to respective bar end portions, with each extendable member 18 having a flange portion 24 engageable with respective element 34 to limit the extension of extendable member 18.

Each element 34 includes an elongated flat bar having side edges connected to the free end portions of respective end portions of bar 14 and being generally parallel to the bottom thereof whereby a hollow box member is formed for the reception therewithin of the sliding extendable member 18.

The overall construction and operation of the burglar bar apparatus hereinabove described will become clearer to those skilled in the art from the following description.

Bars 12 and 14 are welded together in substantially perpendicular array such that each bar is rigidly held in a planar rectangular grid. In the preferred embodiment, bars 12 are welded to the bottom surface portion 32 of the U-shaped bars 14 such that the contact surface and weld therebetween are maximized. The slidable members 18 are inserted in the channels of bars 14 and stop plates 34 are thereafter welded in place to close the adjacent end portions of the U-shaped bars 14, such that slide bar 18 may be extended beyond the end of the second bar 14 only partially until stop lug 24 contacts stop plate 34 and such that guard plate 26 spaced away from bar 18 and bar 14, is at least coextensive with the portion of the length of slide bar 18 which protrudes from the end of second bar 14 such that slide bar 18 is protected and guarded from easy cutting with a bolt cutter or the like.

Once the apparatus is so assembled, the apparatus is placed in the opening of the building such that the bottom 32 of U-shaped bars 14 face outwardly of the building and each extendable mounting member 16 is telescopingly elongated until each mounting plate 20 is in contact with a connecting portion of the frame or casement. Appropriate securing means, such as screws (not shown), are subsequently inserted through spaced apertures 22 and into the frame or casement thereby anchoring assembly 10 in the frame.

As a result of such construction and use, it is seen that the herein disclosed prefabricated burglar bar grid may be adapted to fit a range of different size windows or similar openings with increased safety from external breaching.

While the invention has been described with respect to certain specific embodiments, it will be appreciated that many modifications and changes may be made by those skilled in the art without departing from the spirit of the invention. It is intended, therefore, by the appended claims or cover all such modifications and changes as fall within the true spirit and scope of the invention.

What is claimed as new and what it is desired to secure by Letters Patent of the United States is:

1. In a rectangular burglar bar apparatus for mounting within a rectangular frame opening in a building and having a plurality of spaced bars connected to generally fit such opening, the improvement comprising a pair of extendable frame mounting means attached to one side of said apparatus and each having a frame plate, each said mounting means having an extendable member affixed to said plate to position said plate in contact with the adjacent frame element defining one side of the rectangular frame opening and to be affixed thereto, said spaced bars including a pair of elongated and parallel channel members having opposite end portions, said extendable members being respectively and slideably mounted to adjacent and respective end portions of said channel members a pair of stop means disposed on respective said adjacent end portions for limiting the extension of said extendable members, each of said stop means including elements connected to respective said adjacent end portions, each of said extendable members having a flange portion engageable with respective said element to limit the extension of said extendable member, and guard means mounted to each said plate and extending toward said apparatus to generally overlie each of said extendable members.

2. In the apparatus as defined in claim 1 further comprising another pair of extendable mounting means attached to the other side of said apparatus and each having a frame plate, each said mounting means of said other pair having an extendable member connected to its said plate to position same in contact with the adjacent frame element defining the other side of the rectangular frame opening and to be affixed thereto, and guard means mounted to each said plate of said other pair and extending toward said apparatus to generally overlie each of said extendable member of said other pair.

3. In the apparatus as defined in claim 1 wherein each of said guard means includes a guard plate spaced outwardly from said extendable member for shielding said extendable member.

4. In the apparatus as defined in claim 3 wherein each said guard plate extends laterally above and below said extendable member and extends from said plate toward said apparatus greater than the exposed extension of said extendable member.

5. In the apparatus as defined in claim 1 wherein each said element includes an elongated flat bar having side edges connected to the free end portions of respective said channel member and being generally parallel to the bottom thereof whereby a hollow box member is formed for said sliding extendable member.

6. In the apparatus as defined in claim 5 wherein each said guard means includes a guard plate spaced outwardly from said extendable member and extending between said plate and overlapping said box member and extending laterally above and below said extendable member for shielding same externally of said apparatus.

7. In a burglar bar apparatus for mounting within a frame in a building and having a bar including opposite end portions and extending generally between opposite sides of a frame, the improvement comprising mounting means attached to one end portion of said bar, said mounting means including a plate and an extendable member having an end portion connected to said plate to position same in contact with an adjacent side of a frame whereby said plate may be affixed thereto, said mounting means further including a channel member into which said extendable member is slidingly disposed, said extendable member having a flange portion extending laterally thereof, stop means for limiting the extension of said extendable member from said channel member, said stop means including an element connected to said channel and having a shoulder portion, said flange portion engaging said shoulder portion to limit said extendable member, and guard means mounted to said plate and extending toward said bar to generally overlie said member regardless of the extension thereof, said guard means being closely spaced outwardly of said extendable member and extending laterally thereof whereby breaching said extendable member is inhibited.

8. In the apparatus as defined in claim 7 including another spaced bar having opposite end portions and extending generally between opposite sides of a frame, cross bars for connecting said one and other spaced bars together to form a rectangular burglar bar apparatus; another mounting means attached to one end portion of said other bar adjacent said mounting means including a plate and an extendable member connected to said plate to position same in contact with an adjacent side frame of a frame whereby said other plate may be affixed thereto, and another guard means mounted to said other plate and extending toward said other bar to generally overlie said other extendable member.

9. In the apparatus as defined in claim 8, further comprising a pair of mounting means respectively attached to the other end portions of said bars, each of said mounting means having a plate and an extendable member connected to its said plate to position same in contact with an opposite side of a frame whereby said plate of said pair may be affixed thereto, and guard means mounted to each said plate of said pair and extending toward said bars to generally overlie each of said extendable member of said pair.

10. In the apparatus as defined in claim 7 wherein said guard means includes a guard plate spaced outwardly from said extendable member for shielding said extendable member.

11. In the apparatus as defined in claim 10 wherein said guard plate extends laterally above and below said extendable member and extends from said plate toward said bar greater than the exposed extension of said extendable member.

12. In the apparatus as defined in claim 7 wherein said element includes an elongated flat bar having side edges connected to free end portions of said channel member and being generally parallel to the bottom thereof whereby a hollow box member is formed for said sliding extendable member.

* * * * *